US012320597B2

(12) United States Patent
Rhee et al.

(10) Patent No.: US 12,320,597 B2
(45) Date of Patent: Jun. 3, 2025

(54) PLATE-TYPE HEAT EXCHANGER

(71) Applicant: Hanon Systems, Daejeon (KR)

(72) Inventors: Sangyong Rhee, Daejeon (KR); Hyunkeun Shin, Daejeon (KR); Sang Ok Lee, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 325 days.

(21) Appl. No.: 17/908,089

(22) PCT Filed: Feb. 26, 2021

(86) PCT No.: PCT/KR2021/002430

§ 371 (c)(1),
(2) Date: Aug. 30, 2022

(87) PCT Pub. No.: WO2021/177668

PCT Pub. Date: Sep. 10, 2021

(65) Prior Publication Data

US 2023/0095820 A1 Mar. 30, 2023

(30) Foreign Application Priority Data

Mar. 5, 2020 (KR) ..... 10-2020-0027606
Mar. 12, 2020 (KR) ..... 10-2020-0030741

(51) Int. Cl.
*F28F 3/04* (2006.01)
*F28D 9/00* (2006.01)
*F28F 3/08* (2006.01)

(52) U.S. Cl.
CPC ..... *F28F 3/04* (2013.01); *F28D 9/0031* (2013.01); *F28F 3/08* (2013.01)

(58) Field of Classification Search
CPC ..... F28F 3/04; F28F 3/08; F28D 9/0031
(Continued)

(56) References Cited

U.S. PATENT DOCUMENTS 6,199,626 B1 * 3/2001 Wu ..... F28F 3/027 165/166
2015/0369115 A1 * 12/2015 Kim ..... F28F 27/02 165/103

(Continued)

FOREIGN PATENT DOCUMENTS

CN 203785330 U 8/2014
EP 2878909 A1 6/2015

(Continued)

OTHER PUBLICATIONS

English Translation of Official Action issued Mar. 17, 2025 in related Chinese Patent Application No. 202180018877.1 , 21 pgs.

*Primary Examiner* — Claire E Rojohn, III
(74) *Attorney, Agent, or Firm* — NORTON ROSE FULBRIGHT US LLP

(57) ABSTRACT

The purpose of the present invention is to provide a plate-type heat exchanger in which the formation of burrs and chips during fin processing may be eliminated by eliminating fin processing work for stacking and bonding fins and plates. In order to achieve the above purpose, a plate-type heat exchanger according to the present invention is characterized by comprising: plates which include an inlet formed on one side in the longitudinal direction, an outlet formed on the other side in the longitudinal direction, and a flow surface formed between the inlet and the outlet; and a fin part which is inserted into a plate part formed by bonding a pair of the plates and rests on the flow surface. The plates include a fin part movement preventing means to ensure that one end of the fin part in the longitudinal direction is spaced a certain distance from the inlet and the other end of the fin part in the longitudinal direction is spaced a certain distance from the outlet such that the fin part rests only on the flow surface.

18 Claims, 12 Drawing Sheets

(58) Field of Classification Search
USPC ..... 165/166
See application file for complete search history.

(56) References Cited

U.S. PATENT DOCUMENTS

| | | | | |
|---|---|---|---|---|
| 2016/0363391 | A1* | 12/2016 | Kim | F28F 9/0226 |
| 2019/0160908 | A1* | 5/2019 | Kim | F28D 9/005 |
| 2021/0283992 | A1* | 9/2021 | Rhee | F28F 9/0246 |
| 2023/0095820 | A1* | 3/2023 | Rhee | F28F 13/12<br>165/166 |

FOREIGN PATENT DOCUMENTS

| | | | |
|---|---|---|---|
| JP | H09178383 | | 7/1997 |
| JP | 2000-018872 | A | 1/2000 |
| JP | 2005009848 | A | 1/2005 |
| JP | 2005083623 | A | 3/2005 |
| JP | 2013-534608 | A | 9/2013 |
| JP | 2015203508 | A | 11/2015 |
| JP | 2017-223430 | A | 12/2017 |
| KR | 10-2001-0113676 | A | 12/2001 |
| KR | 20110134650 | A | 12/2011 |
| KR | 101116476 | B1 | 3/2012 |
| KR | 10-1651799 | B1 | 8/2016 |
| WO | 2014/061105 | A1 | 4/2014 |

* cited by examiner

PLATE-TYPE HEAT EXCHANGER

CROSS REFERENCE TO RELATED APPLICATIONS

This application is a national phase under 35 U.S.C. § 371 of International Application No. PCT/KR2021/002430 filed on Feb. 26, 2021, which claims the benefit of priority from Korean Patent Application Nos. 10-2020-0030741 filed on Mar. 12, 2020 and 10-2020-0027606 filed on Mar. 5, 2020. The entire contents of these applications are incorporated herein by reference in their entirety.

TECHNICAL FIELD

The present invention relates to a plate-type heat exchanger, and more particularly, to a plate-type heat exchanger requiring no additional processing work to assemble fins and plates to each other.

BACKGROUND ART

In general, a heat exchanger is a device designed to exchange heat between two or more fluids. The heat exchanger may be used to exchange heat of different fluids to cool or heat the fluid, and may be typically applied to a vehicle air conditioning system, a refrigerator, an air conditioner, etc.

In general, the heat exchanger applied to the vehicle air conditioning system may be an air conditioner including a plurality of tubes connected to each other between a pair of header tanks, installed on a flow path of the air conditioning system for a heat exchange fluid which is supplied through an inlet of the header tank to exchange heat with outside air when passing through the tube, and guiding the fluid passing through the tube to a flow pipe through an outlet of the header tank to cool or heat a vehicle interior space.

As shown in FIG. 1, referring to Korea Patent Laid-Open Publication No. 10-2011-0134650, a heat exchanger 1000 according to a prior art may include a plurality of plates 500 stacked on each other, in which the plate 500 has a first medium inlet 121 and a first medium outlet 122, and fins 300 are positioned only in partial areas of a first medium space 100 and a second medium space 200. Here, a corner fin 320 may be positioned in a portion where a first medium tank part 110 or a second medium tank part 210 is not positioned around positions of the first medium inlet 121, the first medium outlet 122, a second medium inlet 221 and a second medium outlet 222 of the first and second medium spaces 100 and 200. To this end, hole-processing work may be required for the fin to include a hole having the same size as that of the first medium inlet 121, the first medium outlet 122, the second medium inlet 221 and the second medium outlet 222.

However, when processing such number of holes, machining burrs or chips may occur on a surface of a fin having a complex structure. The burrs or chips may adversely affect internal cleanliness of the plate after brazing work, and sometimes interfere with assembly of the plate to cause a brazing work failure.

Meanwhile, as shown in FIG. 2, referring to Korean Patent Publication No. 10-1116476, in a heat exchanger plate according to another prior art, a border 3 surrounds a port hole, the port hole being positioned in a plate 1 or 2 and connecting a space between the plate 1 and the plate 2 to each other. The plate 1 and plate 2 may be brazed and sealed to each other along a ring-shaped contact region around the border 3 of a port opening.

However, when leakage occurs at a border 13 of the port opening which is to be kept airtight due to a manufacturing problem or the like, the mutual airtightness may be destroyed, and the fluids flowing in the different plates may thus be mixed with each other. When the fluids are mixed with each other, an operation of an entire system may be disrupted, and if the vehicle is in a driving operation, its operation may be very risky.

Therefore, it is necessary to design a plate-type heat exchanger structure which may reduce occurrence of the burrs or chips because there is no additional work after work to form the fins, fundamentally prevent the internal leakage, and prevent fluids for different operation from being mixed with each other.

RELATED ART DOCUMENT

Patent Document

Korea Patent Laid-Open Publication No. 10-2011-0134650 (published on Dec. 15, 2011)

Korean Patent Publication No. 10-1116476 (published on Feb. 7, 2012)

DISCLOSURE

Technical Problem

An object of the present invention is to provide a plate-type heat exchanger which may prevent occurrence of burrs or chips during fin processing by eliminating fin processing work when stacking and coupling fins and plates to each other.

Technical Solution

In one general aspect, a plate-type heat exchanger includes: plates each including an inlet positioned in one side thereof in a longitudinal direction, an outlet positioned in the other side thereof in the longitudinal direction, and a flow surface positioned between the inlet and the outlet; and a fin part inserted into a plate part formed by coupling the pair of plates to each other, and rested on the flow surface, wherein the plate includes a fin part movement-preventing means for the fin part to be rested only on the flow surface by allowing one end of the fin part in the longitudinal direction to be spaced apart from the inlet by a certain distance, and the other end of the fin part in the longitudinal direction to be spaced apart from the outlet by a certain distance.

Furthermore, the fin part movement-preventing means may include a step part positioned around the flow surface, the inlet or the outlet, and defining a position on which the fin part is rested.

Furthermore, the step part may surround a corner of the fin part that is positioned close to the inlet, i.e. any one or more corners of one or the other side of the fin part in the longitudinal direction, and may not surround a corner of the fin part that is closest to the inlet or a corner of the fin part that is closest to the outlet.

Furthermore, the step part may further include a round positioned to correspond to a corner edge of the fin part.

Furthermore, the fin part movement-preventing means may include a stopper protruding toward a surface where the fluid flows from a portion of the flow surface, positioned at a point between the inlet and the flow surface or between the flow surface and the outlet.

Here, the stoppers may respectively be positioned on the pair of plates, and in contact with each other inside the plate part.

In addition, the stoppers may be a plurality of pillars, and the plurality of pillars may be radially arranged with respect to the inlet and the outlet, respectively.

Furthermore, the plate-type heat exchanger may further include a protrusion protruding toward the surface where the fluid flows from a certain region of the flow surface, positioned at a point between the plurality of stoppers when the plurality of the stopper are provided.

Furthermore, the fin part may not include a hole having a size corresponding to that of the inlet or outlet.

Furthermore, the fin part may include a through gap positioned between the fins forming wave waveforms different from each other.

Furthermore, the fin part may include a plate fin in an offset-strip shape.

Furthermore, the plate part may include first and second plates, at least one ring part may be positioned on a circumference of the first plate, and at least one groove part may be positioned in a circumference of the second plate and to which the ring part is coupled.

Furthermore, the plate-type heat exchanger may further include: a first manifold which is positioned at the plate part and through which any one of a first fluid and a second fluid is introduced and discharged, and a second manifold which is positioned at the plate part and through which a fluid not flowing through the first manifold among the first fluid or the second fluid is introduced and discharged, wherein the first manifold and the second manifold are physically separated from each other by the step part.

Furthermore, the first manifold may include an inlet part including the pair of inlets and through which any one of the first fluid or the second fluid is introduced, a flow space part including the pair of flow surfaces and through which the fluid introduced through the inlet part flows, and an outlet part including the pair of outlets and through which the fluid passing through the flow space part is discharged.

Furthermore, the second manifold may include a first movement part in which the fluid not flowing through the first manifold flows and a second movement part in which the fluid passing through the first movement part flows.

Here, the first manifold and the second manifold may be positioned in such a manner that a straight line connecting the inlet part and the outlet part to each other and a straight line connecting the first movement part and the second movement part to each other intersect each other in an "X" shape.

Furthermore, the step part may be formed by the first manifold having a certain depth and protruding outward from the plate part.

Furthermore, the plate part may further include a through outlet part passing through a certain area between the step part and the second manifold.

Furthermore, the first manifold and the second manifold respectively positioned at different plate parts may be cross-stacked on each other when the plurality of plate parts are stacked on each other.

Furthermore, the flow space part may further include a vortex generation part including a plurality of protrusions protruding inward in a state where the plate parts are coupled to each other.

Advantageous Effects

As set forth above, the plate-type heat exchanger according to the present invention requires no additional processing process to couple the plate and the fin part to each other, to shorten the production time, and prevent the foreign material from occurring in the processing process, thereby increasing the internal cleanliness of a pair of plate assembly, into which the fin part is inserted.

BEST MODE

Hereinafter, the technical spirit of the present invention will be described in more detail with reference to the accompanying drawings. Terms and words used in the present specification and claims are not to be construed as a general or dictionary meaning, but are to be construed as meaning and concepts meeting the spirit of the present invention based on a principle that the present inventors may appropriately define the concepts of terms in order to describe their inventions in best mode.

Therefore, exemplary embodiments disclosed in the present specification and configurations shown in the accompanying drawings are only exemplary embodiments of the present invention and do not represent the spirit of the present invention, and it is to be understood that various modifications that may replace the exemplary embodiments disclosed in the present specification and the configurations shown in the accompanying drawings at a time point at which the present invention is filed.

Hereinafter, the spirit of the present invention will be described in more detail with reference to the accompanying drawings. The accompanying drawings are only examples shown in order to describe the spirit of the present invention in more detail. Therefore, the spirit of the present invention is not limited to forms of the accompanying drawings.

Figure 1:
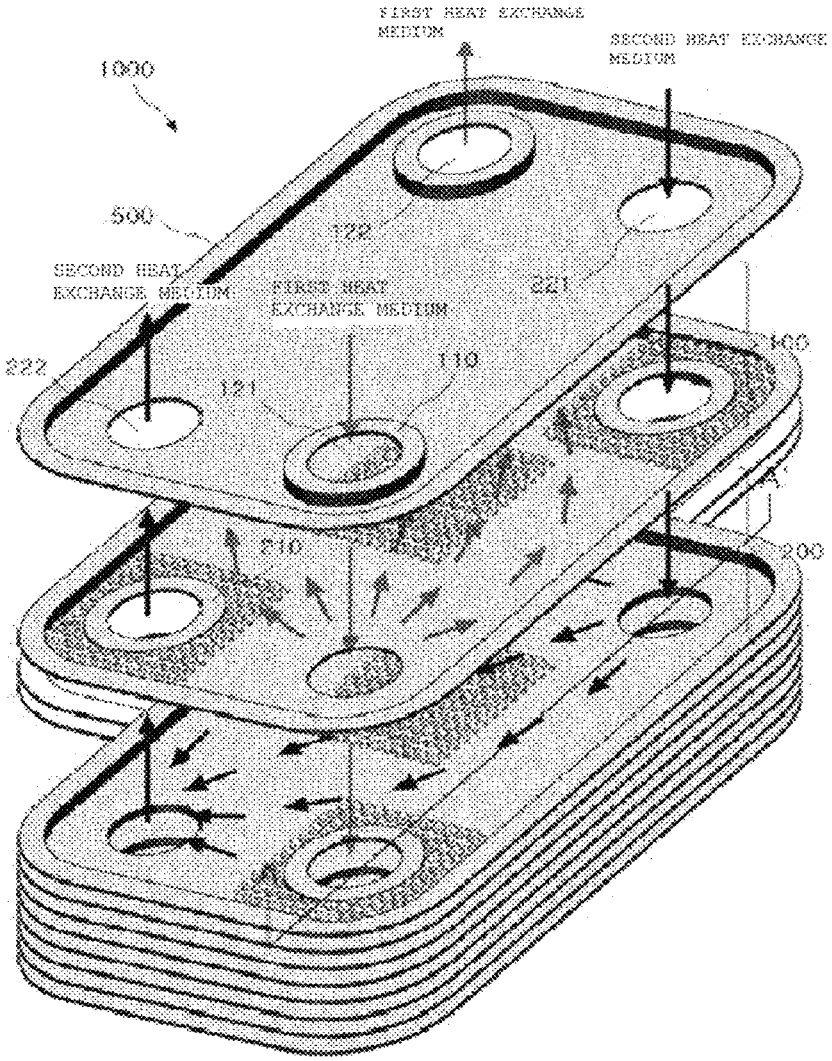
FIG. 1 is a perspective view of a plate-type heat exchanger according to a prior art.
Figure 2:
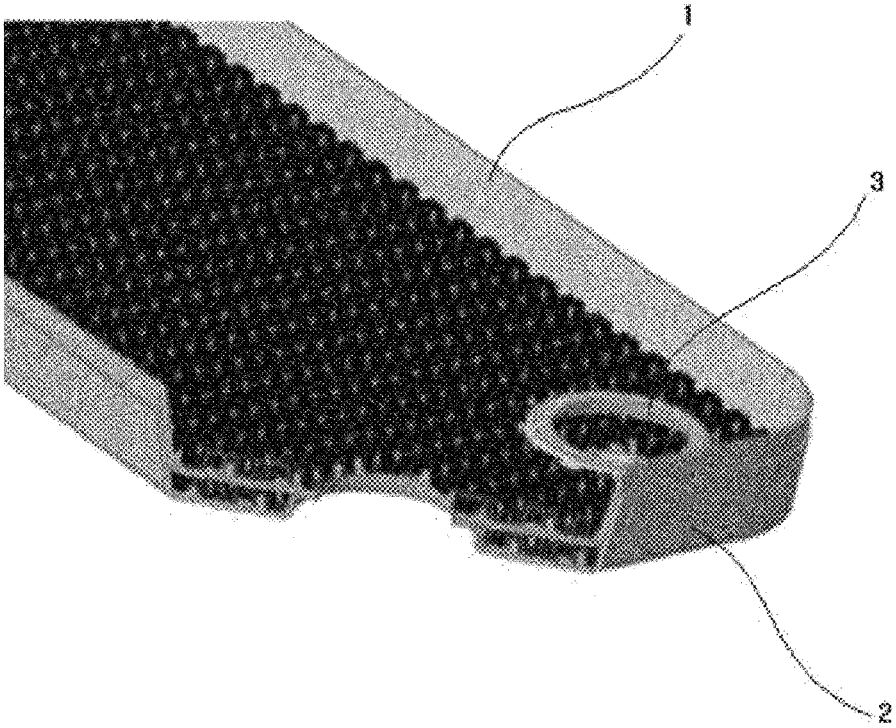
FIG. 2 is a plan view showing a portion of a heat exchange plate according to another prior art.
Figure 3:
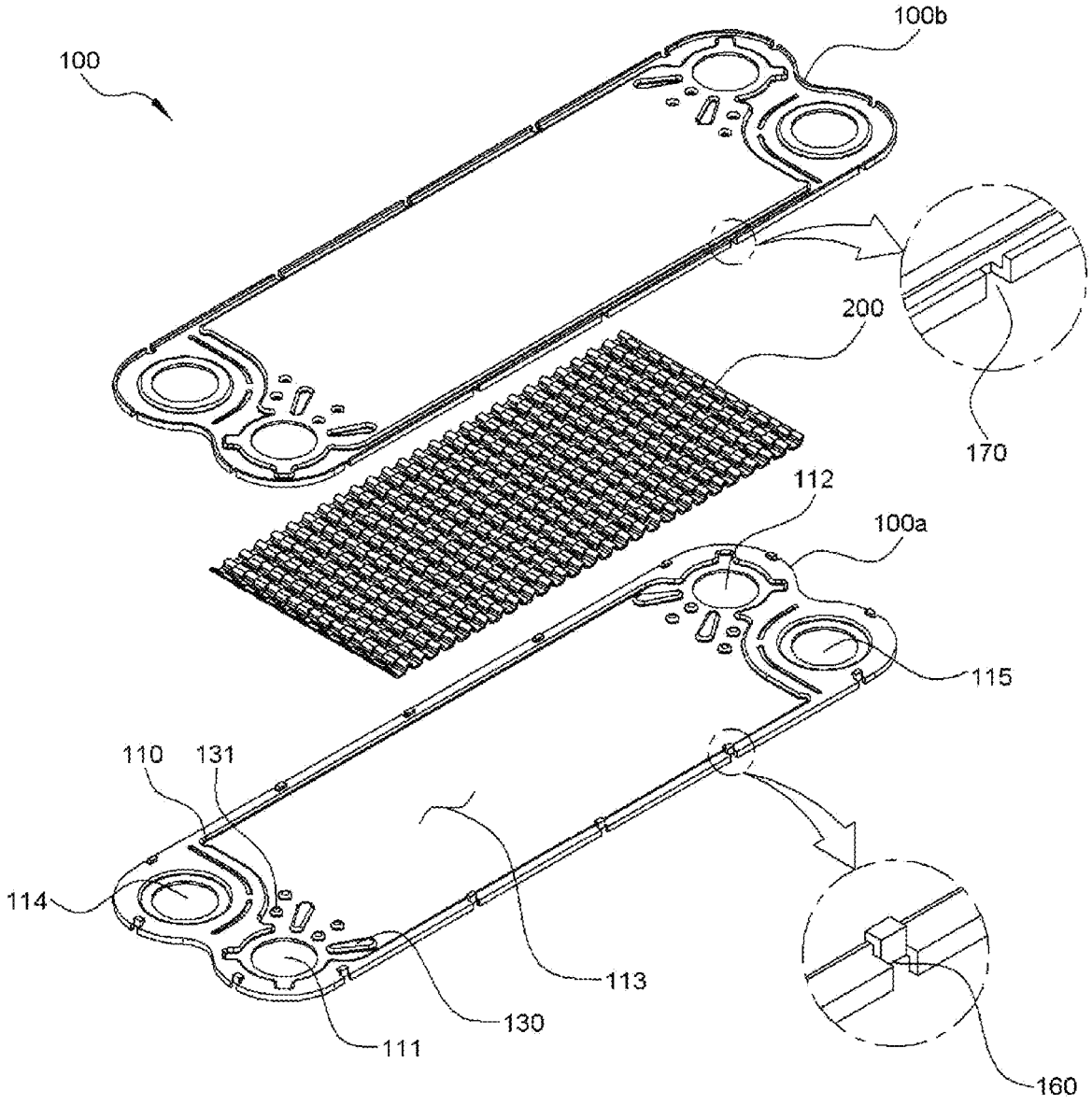
FIG. 3 is an exploded perspective view showing an example of a pair of plates according to the present invention.
Figure 4:
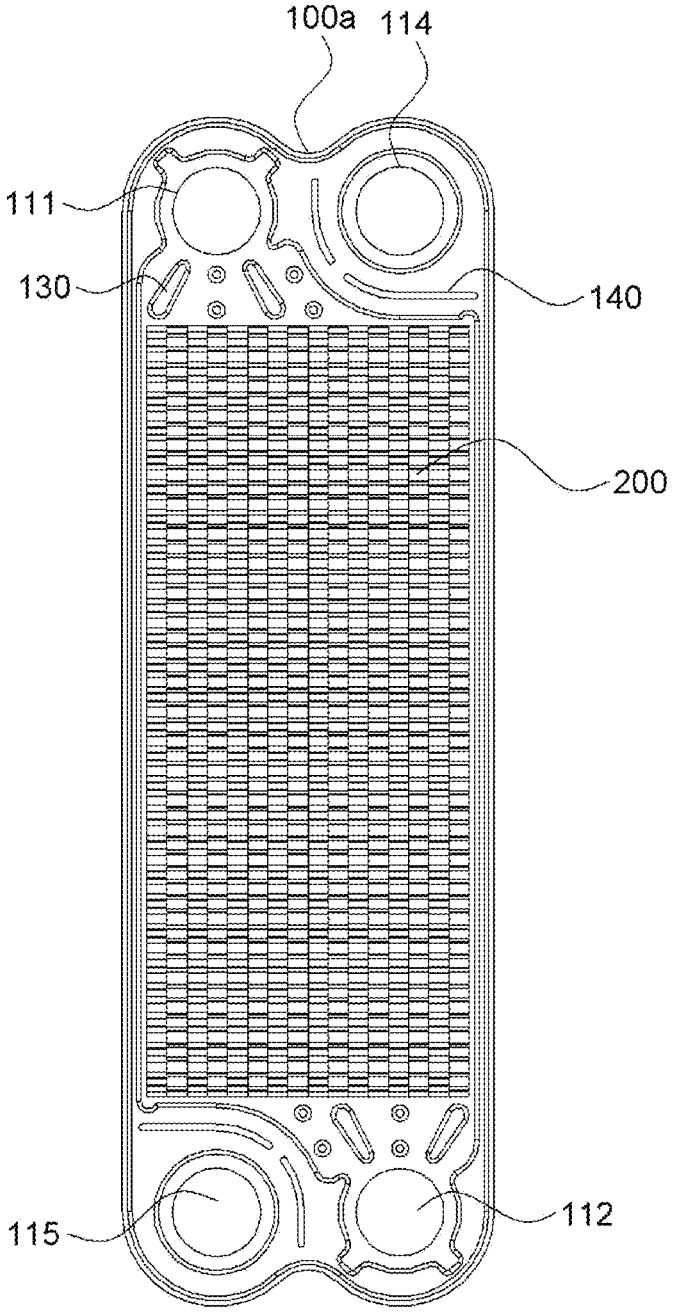
FIG. 4 is a plan view showing that a plate and a fin part are coupled to each other according to the present invention.

Referring to FIGS. 3 and 4, a plate-type heat exchanger according to the present invention may include: plate 100*a* and 100*b* each including an inlet 111 positioned in one side thereof in a longitudinal direction, an outlet 112 positioned in the other side thereof in the longitudinal direction, and a flow surface 113 positioned between the inlet 111 and the outlet 112; and a fin part 200 inserted into a plate part 100 formed by coupling the pair of plates 100*a* and 100*b* to each other, and rested on the flow surface 113, wherein the plates 100*a* and 100*b* each include a fin part movement-preventing means for the fin part 200 to be rested only on the flow surface 113 by allowing one end of the fin part 200 in the longitudinal direction to be spaced apart from the inlet 111 by a certain distance, and the other end of the fin part 200 in the longitudinal direction to be spaced apart from the outlet 112 by a certain distance.

Here, the inlet 111 and the outlet 112 may be positioned in the same surface as the flow surface 113.

In addition, the inlet 111 and the inlet or outlet of another fluid may be positioned in one side of the plate 100*a* or 100*b*, and the outlet 112 and the inlet or outlet of another fluid may be positioned in the other side of the plate 100*a* or 100*b*.

Here, the inlet or outlet of another fluid positioned in one side of the plate 100*a* or 100*b* and the inlet or outlet of another fluid positioned in the other side of the plate 100*a* or 100*b* may each have a height different from that of the inlet 111 or outlet 112.

In addition, the plate 100*a* or 100*b* may have a flow path wider from the inlet 111 to the flow surface 113, and narrower from the flow surface 113 to the outlet 112.

The fin part 200 may be inserted between the pair of plates 100*a* and 100*b* so that its movement in a Z-axis direction is fixed, and the pair of plates 100*a* and 100*b* may be symmetric to each other with respect to the plates opposing each other, and coupled to each other in a symmetric state.

Here, one end of the fin part 200 may be spaced apart from the inlet 111 by the certain distance, and the other end of the fin part 200 may be spaced apart from the outlet 112 by the certain distance, and when a fluid introduced through the inlet 111 passes through the flow surface 113, the fluid may thus be brought into contact with the fin part 200, thereby increasing heat exchange efficiency.

In addition, the flow path through which the fluid is moved from the inlet 111 to the flow surface 113 may be wider to assist the fluid introduced from the inlet 111 in being evenly spread on the flow surface 113, and the flow path through which the fluid is moved from the flow surface 113 to the outlet 112 may be narrower to assist the fluid passing through the flow surface 113 in being collected and discharged to the outlet 112.

Here, the inlet and outlet of another fluid positioned in the plate 100*a* or 100*b* may be positioned in a surface on a step part to have a height different from a surface on which the fin part 200 is rested, and the inlet 111 and the outlet 112 may have the same height as the surface on which the fin part 200 is rested.

The fin part 200 may be applied in any shape as long as the fin part has a size or shape enabling the fin part to be rested on the flow surface 113, and no additional processing work may be required to couple the plates 100*a* and 100*b* and the fin part 200 to one another. That is, the fin part 200 may be rested on the flow surface 113 with no additional processing after its forming work and cutting work.

The plate-type heat exchanger according to the present invention may include the fin part 200 having a simple shape and inserted between the pair of plates 100*a* and 100*b* based on the above features to prevent the occurrence of burrs or chips in the plates 100*a* and 100*b*, thereby improving internal cleanliness and manufacturability after brazing work.

Figure 5:
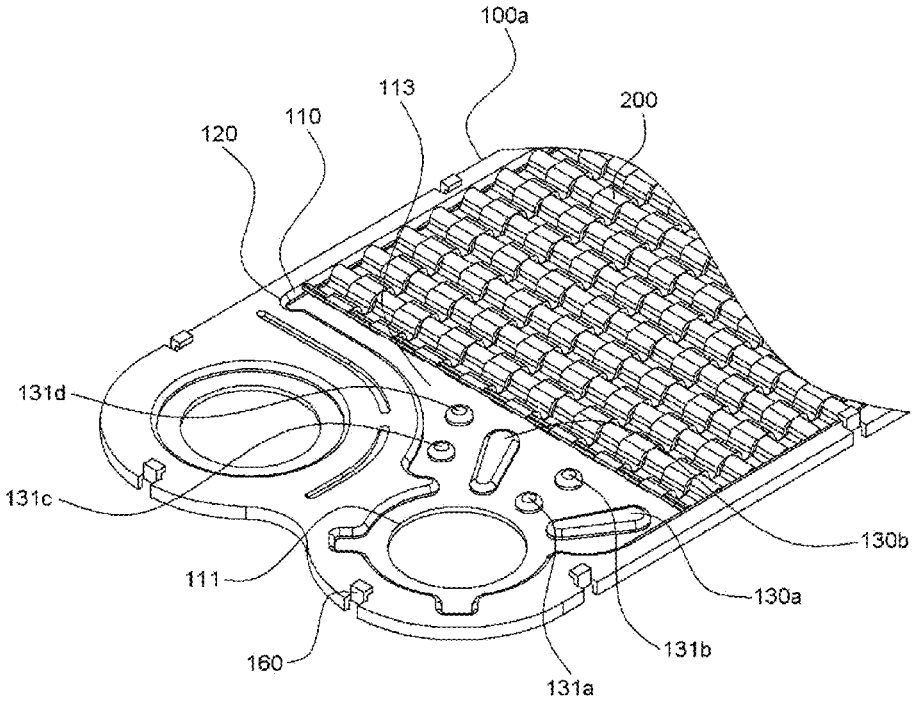
FIG. 5 is an enlarged perspective view showing that the plate and the fin part are coupled to each other according to the present invention.

Referring to FIG. 5, the fin part movement-preventing means may include a step part 110 positioned around the flow surface 113, the inlet 111 or the outlet 112, and defining a position on which the fin part 200 is rested.

The step part 110 may be positioned around the flow surface 113. Therefore, a step may be positioned between the flow surface 113 and a portion around the flow surface 113 to have a space where the fluid introduced through the inlet 111 may flow and simultaneously, a space where the fin part 200 may be rested.

The step part 110 may select the resting position of the fin part 200 and simultaneously guide the space where the fluid moved on the flow surface 113 flows.

The step part 110 may have a height in a direction in which the fluid flows from the flow surface 113, and the fluid may flow within a range in which the step part 110 is positioned.

Here, the step part 110 may surround any one or more corners of one side or the other side of the fin part 200 in the longitudinal direction, and may not surround a corner of the fin part 200 that is closest to the inlet 111 or a corner of the fin part 200 that is closest to the outlet 112.

The fin part 200 may be fixed in X-axis and Y-axis directions when the step part 110 has a shape to surround the corner of the fin part 200.

Here, the corner of the fin part 200 that is surrounded by the step part 110 may be neither a corner brought into first contact with the fluid introduced through the inlet 111 nor a corner brought into last contact with the fluid discharged through the outlet 112. That is, the step part 110 may surround the corner of the fin part 200 not to obstruct the flow of the fluid introduced through the inlet 111 or the flow of the fluid discharged through the outlet 112.

In addition, the step part 110 may further include a round 120 positioned to correspond to a corner edge of the fin part 200.

The round 120 may have a semicircular shape, and prevent the corner edge of the fin part 200 from being brought into contact with an edge of the step part 110, thereby preventing deformations of the fin part 200 and the plates 100*a* and 100*b* and simultaneously allowing an edge vicinity of the step part 110 to fix an edge vicinity of the fin part 200.

In addition, the fin part movement-preventing means may include a stopper 130 protruding toward the surface where the fluid flows from a certain region of the flow surface 113, positioned at a point between the inlet 111 and the flow surface 113 or between the flow surface 113 and the outlet 112.

The stopper 130 may fix the position of the fin part 200 so that the fin part 200 does not deviate from the position on which the fin part 200 is rested in the flow surface 113. Simultaneously, the pair of stoppers 130 may be brought into contact with each other when the pair of plates 100*a* and 100*b* are coupled to each other, thereby not only increasing an area where the plates 100*a* and 100*b* are coupled to each other, but also absorbing impact and pressure from the outside the pair of plates 100*a* and 100*b* which are coupled to each other to minimize damage and shape deformation of the plates 100*a* and 100*b*.

The stopper 130 may have a certain length toward the flow surface 113 from the inlet 111 or have a certain length toward the outlet 112 from the flow surface 113. The stopper 130 may be wider from the inlet 111 toward the flow surface 113 and wider from the flow surface 113 toward the outlet 112.

In addition, as shown in FIG. 5, the stopper 130 may include a first stopper 130*a* and a second stopper 130*b*, which are positioned in such a manner that a distance between the first stopper 130*a* and the second stopper 130*b* is wider from the inlet 111 toward the flow surface 113 and narrower from the flow surface 113 toward the outlet 112.

In addition, a portion of the stopper 130 that is in contact with the fin part 200 or is closest to the fin part 200 may be rounded to minimize deformations of the stopper 130 and the fin part 200.

Here, referring to FIG. 3, the stoppers 130 may respectively be positioned on the first plate 100*a* and the second plate 100*b*, and the stoppers 130 respectively positioned on the first plate 100*a* and the second plate 100*b* may be in contact with each other.

As described above, the stopper 130 positioned on the first plate 100*a* and the stopper 130 positioned on the second plate 100*b* may be brought into contact with each other. Here, the stoppers may increase the coupling area of the plate part 100, thereby increasing a coupling strength, and absorb the impact and the pressure when the plurality of plate parts 100 are coupled to each other, thereby minimizing the damage and shape deformation of each plate part 100.

The stoppers 130 may be a plurality of pillars, and the plurality of pillars may have different shapes, and be radially arranged with respect to an inlet part 101 or an outlet part 102, respectively.

When the plurality of pillars are radially arranged, the plurality of pillars arranged adjacent to the inlet part 101 may be radially arranged with respect to the inlet part 101, thus allowing the fluid introduced through the inlet part 101 to be spread effectively and delivered to a flow space part 103, and the plurality of pillars arranged adjacent to the outlet part 102 may be radially arranged with respect to the outlet part 102, thus allowing the fluid passing through the flow space 103 to be evenly spread to enter the outlet part 102.

In addition, the plate-type heat exchanger according to the present invention may further include a protrusion 131 protruding toward the surface where the fluid flows from a certain region of the flow surface 113, positioned at a point between the plurality of stoppers 130 when the plurality of the stopper 130 are provided. The protrusion 131 may have a shape of a circle having a size smaller than that of the stopper 130, and the plurality of protrusions may be arranged in a longitudinal direction of the stopper 130. For example, when the stopper 130 includes the first stopper 130*a* and the second stopper 130*b*, the protrusion 131 may also include a first protrusion 131*a*, a second protrusion 131*b*, a third protrusion 131*c* and a fourth protrusion 131*d*. The first protrusion 131*a* and the second protrusion 131*b* may be positioned between the first stopper 130*a* and the second stopper 130*b*, and the third protrusion 131*c* and the fourth protrusion 131*d* may be positioned adjacent to the second stopper 130*b*. The first protrusion 131*a* to the fourth protrusion 131*d* may also be radially arranged with respect to the inlet 111 or the outlet 112.

The protrusion 131 may serve as a pillar supporting the flow surface 113 when the pair of plates 100*a* and 100*b* are coupled to each other, and absorb the pressure and the impact that the plates 100*a* and 100*b* receive from the outside, thereby increasing the coupling strength of the plates 100*a* and 100*b* to reduce their shape deformation and damage.

Figure 6:
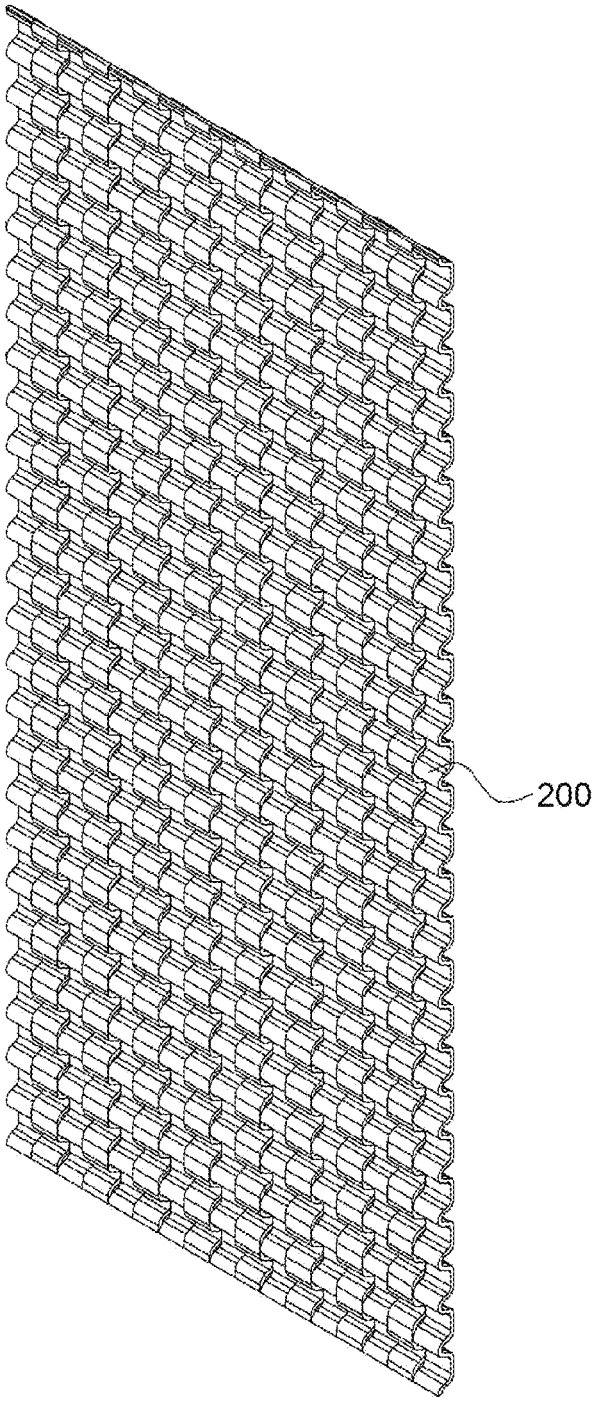
FIG. 6 is a perspective view of the fin part according to the present invention.

Referring to FIG. 6, the fin part 200 may not include a hole having a size corresponding to that of the inlet 111 or outlet 112.

That is, the fin part 200 may be rested on the flow surface 113 not to overlap the inlet 111 or the outlet 112 regardless of the shape or position of the inlet 111 or the outlet 112, and the fin part 200 may not require trimming work or hole-processing (or blanking) work. When the fin part 200 covers the shape of the inlet 111 or outlet 112 and is rested or installed on the plate 100*a* and 100*b*, the trimming work or the blanking work may be required, and the chips or the burrs may occur by this work, which may reduce the internal cleanliness and manufacturability of the plate 100*a* or 100*b*. The present invention may provide the plate-type heat exchanger which may be easily manufactured and have a simple manufacturing process while solving these problems.

Figure 7:
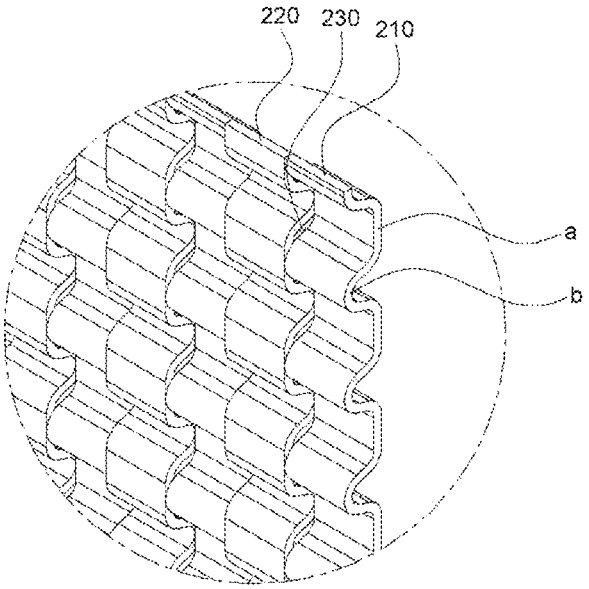
FIG. 7 is an enlarged perspective view of the fin part according to the present invention.

Referring to FIGS. 6 and 7, the fin part 200 may be made by coupling the plurality of fins forming different wave waveforms to each other.

That is, the fin part 200 may include the plurality of fins forming the wave waveforms each having the same length and connected to each other in the same extension direction. Here, the plurality of fins may have fin peaks "b" and fin valleys "a" having heights different from each other, and have the fin peaks "b" and the fin valleys "a" having the same height as each other.

The fin part 200 may include a repeating arrangement of the plurality of fins having different waveforms, such as the first fin 210 and the second fin 220, and types of the different waveforms are not limited.

Here, the fin part 200 may include a through gap 230 positioned between the fins forming the wave waveforms different from each other.

That is, when the first fin 210 and the second fin 220 have the different waveforms and are connected with each other, the peaks and the valleys may be formed at different points, and due to this height difference, the through gap 230 may be positioned between the first fin 210 and the second fin 220.

The plurality of fins may be connected with each other at regular intervals, and the adjacent fins may form the different waveforms, such that the fluid flowing on the flow surface 113 may flow through the through gap 230 between the plurality of fins.

When the fin part 200 is made by coupling the fins forming the plurality of different wave waveforms, it is possible to increase the area where the fluid and the fin part 200 are in contact with each other, and improve heat exchange performance. In addition, the fin part 200 forming the plurality of wave waveforms may be inserted between the pair of plates 100*a* and 100*b* to increase the coupling strength between the plates 100*a* and 100*b* and the fin part 200 and to absorb the pressure and the impact, transmitted from the outside to the plate plates 100*a* and 100*b* or the fin part 200, thereby minimizing the damage and the shape deformation of the plates 100*a* and 100*b* or the fin part 200.

In addition, the fin part 200 may include a plate fin in an offset-strip shape.

The plate fin may be divided into a plane, wavy, louvered, offset-strip or perforated pin type depending on its shape. Here, the offset-strip shaped fin may be applied to the plate-fin type heat exchanger to show the highest performance.

That is, the plate-type heat exchanger according to the present invention may use, as the fin part 200, the offset-strip shaped fin in a state where the forming work is performed to form the plurality of peaks and valleys on one plate fin and then the cutting work is progressed thereon to cut the offset-strip shaped fin to a size sufficient to be rested on the flow surface 113, to improve the heat exchange performance and eliminate the trimming work and the blanking work to minimize the manufacturing process.

In addition, referring to FIG. 3, the plate part 100 may include the first and second plates 100*a* and 100*b*, at least one ring part 160 which is positioned on a circumference of the first plate 100*a*, and at least one groove part 170 which is positioned in a circumference of the second plate 100*b* and to which the ring part 160 is coupled.

The first plate 100*a* and the second plate 100*b* may have the certain length and be symmetric to each other with respect to a surface on which the plates oppose each other, and the ring part 160 and the groove part 170 may be positioned to be symmetric to each other on the first plate 100*a* and the second plate 100*b*.

In addition, the numbers of the ring part 160 and the groove part 170 may be the same as each other, the plurality of ring parts 160 and the plurality of groove parts 170 may be positioned around the first plate 100*a* and the second plate 100*b*, and the ring part 160 and the groove part 170 may be positioned to be coupled to each other at various positions.

The ring part 160 may be fitted into the groove part 170, and the first plate 100*a* and the second plate 100*b* may thus be coupled to each other by themselves rather than coupled by an external coupling device or coupling tool.

Figure 8:
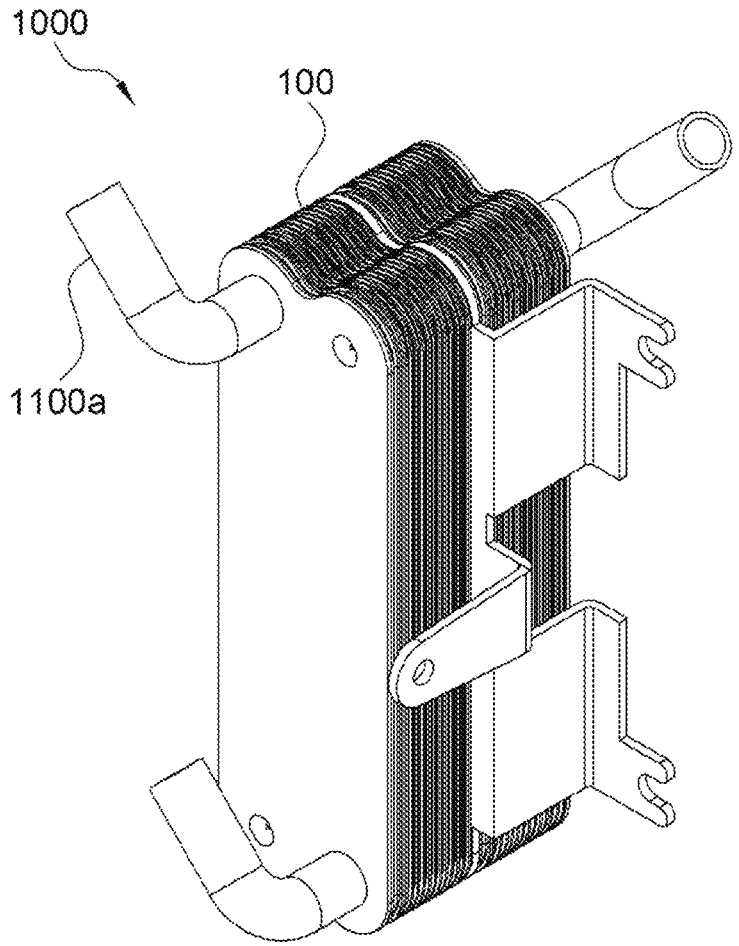
FIG. 8 is a perspective view of an example of the plate-type heat exchanger according to the present invention.
Figure 9:
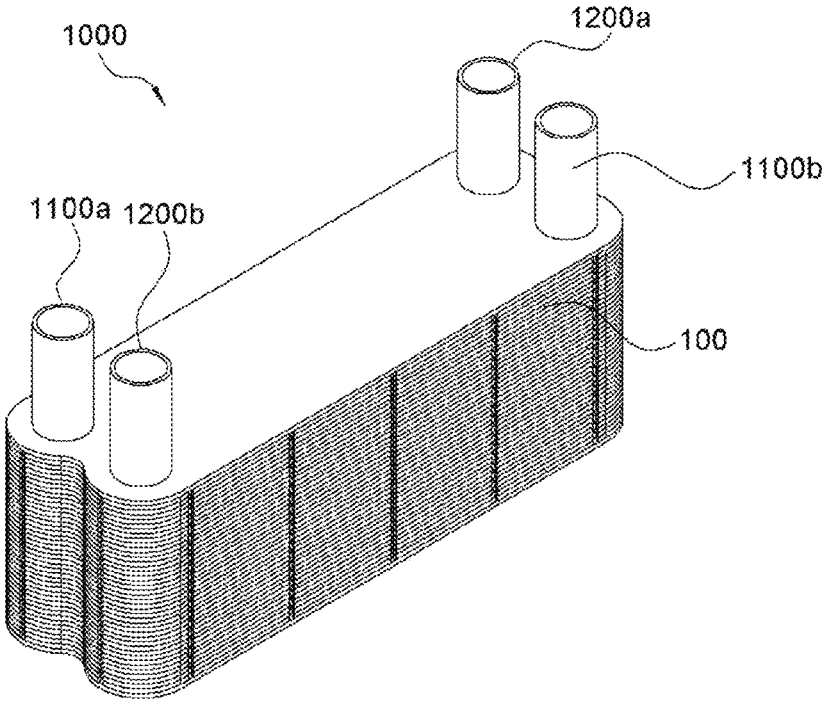
FIG. 9 is a perspective view of another example of the plate-type heat exchanger according to the present invention.
Figure 10:
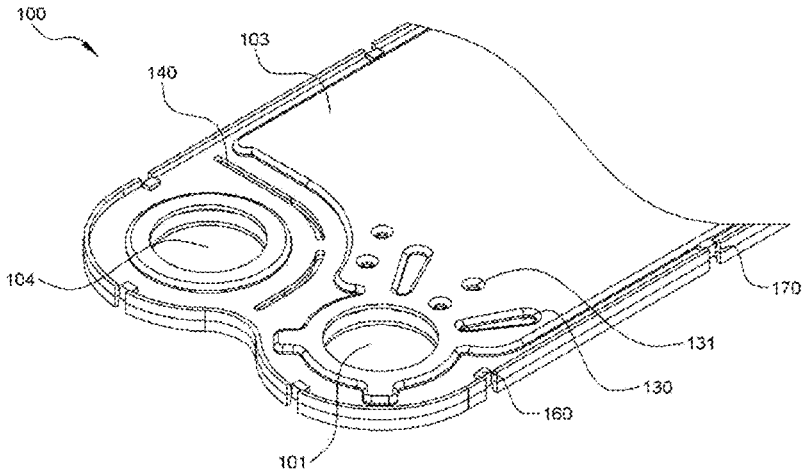
FIG. 10 is a perspective view showing that plate parts are coupled to each other according to the present invention.

Referring to FIGS. 8 to 10, a plate-type heat exchanger 1000 according to the present invention may include a first manifold which is positioned at the plate part 100 and through which any one of a first fluid and a second fluid is introduced and discharged, and a second manifold which is positioned at the plate part 100 and through which a fluid not flowing through the first manifold among the first fluid or the second fluid is introduced and discharged, wherein the first manifold and the second manifold are physically separated from each other by the step.

As shown in FIG. 9, the plate-type heat exchanger 1000 according to the present invention may include a first inlet pipe 1100*a* for introducing the first fluid into the first manifold or the second manifold from the outside, a first outlet pipe 1100*b* for discharging the first fluid from the first manifold or the second manifold to the outside, a second inlet pipe 1200*a* for introducing the second fluid into the first manifold or the second manifold from the outside, and a second outlet pipe 1200*b* for discharging the second fluid from the first manifold or the second manifold to the outside.

The first fluid and the second fluid may be any one of oil or coolant, and a type of the fluid is not limited to oil or coolant.

Positions of the first inlet pipe 1100*a*, the first outlet pipe 1100*b*, the second inlet pipe 1200*a* and the second outlet pipe 1200*b* are not limited, and may depend on a direction in which the first fluid or the second fluid flow.

Here, in the plate-type heat exchanger 1000 according to the present invention, the first fluid or the second fluid flowing in the first manifold through the step positioned on the one plate part 100 may not be delivered to the second manifold, so that the first fluid and the second fluid may not be mixed with each other.

The first fluid and the second fluid may be introduced into different devices through the first outlet pipe 1100*b* and the second outlet pipe 1200*b*, respectively. When the first fluid and the second fluid are mixed with each other in a first manifold region or a second manifold region, device failure may occur and heat exchange may be abnormally operated.

Therefore, the plate-type heat exchanger 1000 according to the present invention solves this problem by physically separating the fluid flowing in the first manifold and the fluid flowing in the second manifold from each other through the step positioned between the first manifold and the second manifold.

Figure 11:
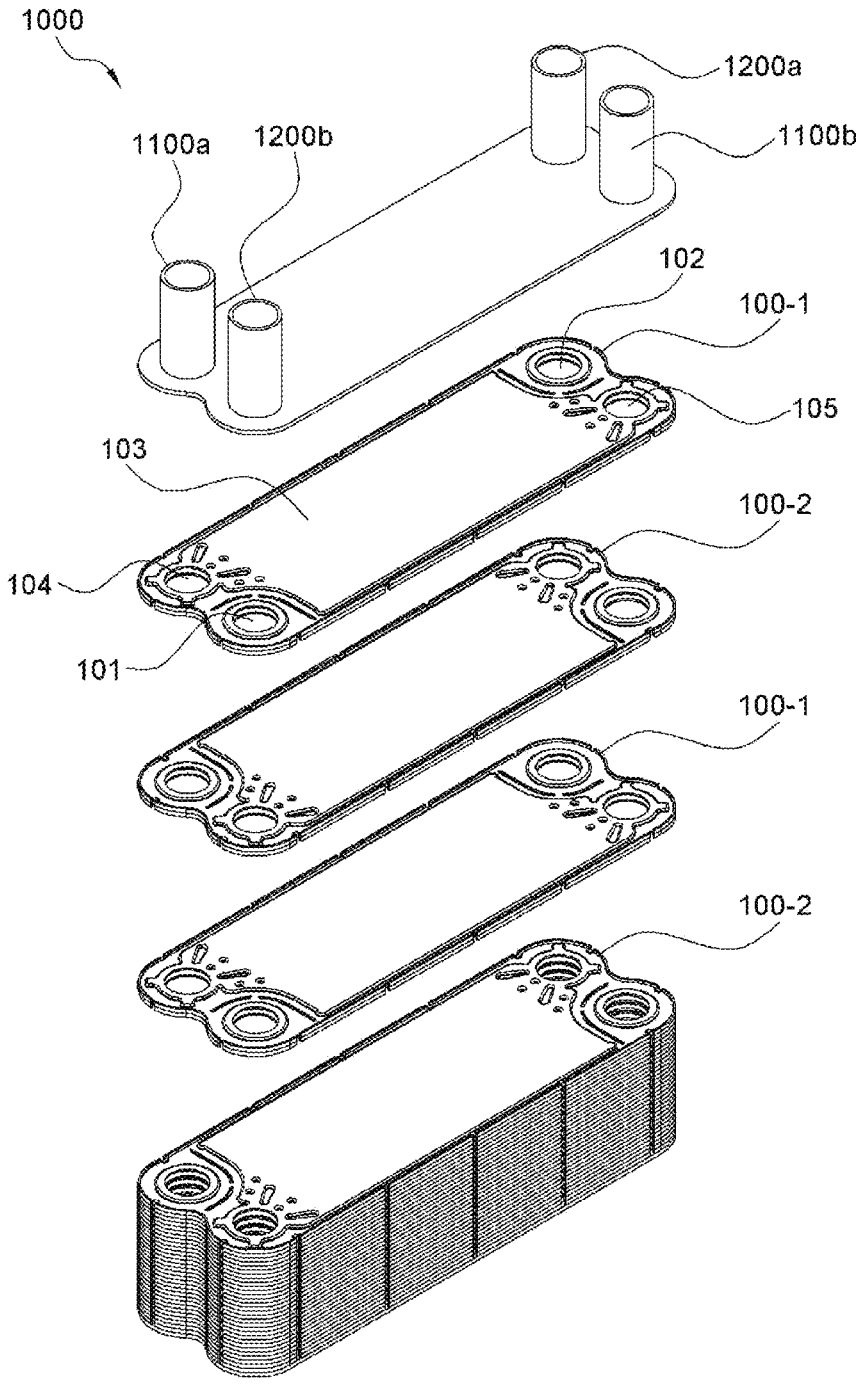
FIG. 11 is an exploded perspective view of the plate-type heat exchanger according to the present invention.

Referring to FIGS. 10 and 11, the first manifold may include an inlet part 101 including the pair of inlets 111 and through which any one of the first fluid or the second fluid is introduced, a flow space part 103 including the pair of flow surfaces 113 and through which the fluid introduced through the inlet part 101 flows, and an outlet part 102 including the pair of outlets 112 and through which the fluid passing through the flow space part 103 is discharged.

The wider surfaces of the first plate 100*a* and the second plate 100*b* may overlap each other by coupling the first plate 100*a* and the second plate 100*b* to each other to form the flow space part 103, the inlet part 101 through which any one of the first fluid or the second fluid passing through the flow space part 103 is introduced, and the manifold through which any one of the first fluid and the second fluid introduced into the flow space part 103 through the inlet part 101 is discharged to the outside.

Here, the second manifold may include a first movement part 104 in which the fluid not flowing through the first manifold flows and a second movement part 105 in which the fluid passing through the first movement part 104 flows. The first movement part 104 may be formed by stacking the pair of first movement units 114 respectively positioned in the first plate 100*a* and the second plate 100*b*, and the second movement part 105 may be formed by stacking the pair of second movement units 115 respectively positioned in the first plate 100*a* and the second plate 100*b*.

Alternatively, the first manifold and the second manifold are positioned in such a manner that a straight line connecting the inlet part 101 and the outlet part 102 to each other and a straight line connecting the first movement part 104 and the second movement part 105 to each other intersect each other in an "X" shape.

Referring to FIG. 9, the step part 110 may be formed by the first manifold having a certain depth and protruding outward from the plate part 100.

The inside of the plate part 100 may refer to a direction in which the flow space part 103 is formed, and the outside of the plate part 100 may refer to a direction of a surface on which the respective plate parts 100 are in contact with each other when the plurality of plate parts 100 are coupled to each other.

Accordingly, the first manifold may protrude from the inside of the plate part to the outside to have the certain depth. Therefore, the step part 110 formed between the first manifold and the second manifold to the certain depth may prevent the fluid flowing in the first manifold from being moved to the second manifold, and prevent the fluid passing through the second manifold from being moved to the first manifold.

Here, the plate part 100 according to the present invention may further include a through outlet part 140 passing through a certain area between the step part 110 and the second manifold 140.

The through outlet part 140 may be positioned between a step region and the second manifold to completely prevent the first fluid and the second fluid from being mixed with each other by allowing the fluid to be discharged to the outside of the plate part 100, when the fluid passing through the second manifold is moved to a point where the step part 110 is positioned, or when the fluid flowing through the first manifold is moved to the point where the step part 110 is positioned.

The through outlet part 140 may prevent the first fluid and the second fluid from being mixed with each other in the plate part 100 as well as preventing the fluid from being mixed with each other in adjacent plate parts 100.

For example, the first fluid flowing in the inlet part 101 of a first plate part 100-1 may pass through the first movement part 104 or second movement part 105 of a second plate part 100-2, or the first fluid may be moved toward the first movement part 104 or the second movement part 105 or the flow space part 103 of the second plate part 100-2. In this case, the fluid may be discharged to the outside by the through outlet part 140 positioned in the second plate part 100-2, and the first fluid and the second fluid may thus be prevented from being mixed with each other.

The above-described operation may also be applied to a case where the second fluid flowing in the inlet part 101 of the second plate part 100-2 passes through the first movement part 104 or second movement part 105 of the first plate part 100-1.

Referring to FIG. 11, in the plate-type heat exchanger 1000 according to the present invention, the first manifold and the second manifold respectively positioned at different plate parts 100 are cross-stacked on each other when the plurality of plate parts 100 are stacked on each other.

That is, at least one of one surface and the other surface of the first plate part 100-1 and at least one of one surface and the other surface of the second plate part 100-2 may be cross-stacked in contact with each other, the first plate part 100-1 may be coupled between the two second plate parts 100-2 or between the first plate part 100-1 and the second plate part 100-2, and the second plate part 100-2 may also be coupled between the two first plate parts 100-1 or between the first plate part 100-1 and the second plate part 100-2.

Therefore, the fluid introduced into the flow space part 103 of the first plate part 100-1 through the inlet part 101 positioned in the first plate part 100-1 may pass through the outlet part 102 positioned in the first plate part 100-1, and the first movement part 104 or the second movement part 105, positioned in the second plate part 100-2.

Here, the plurality of the inlet part 101 and the first movement part 104 or the second movement part 105 may be arranged concentrically with each other to form two different fluid-movement channels based on an arrangement order, and the outlet part 102 and the first movement part 104 or the second movement part 105 may be arranged concentrically with each other to form two different fluid-movement channels based on the arrangement order.

The four fluid-movement channels may thus be formed based on the arrangement order of the inlet part 101, the outlet part 102, the first movement part 104 and the second movement part 105, by coupling the first plate part 100-1 and the second plate part 100-2 to each other.

Among the four channels formed through the four manifolds, a channel connected to the first inlet pipe 1100*a* may deliver the first fluid to the plate part 100, a channel connected to the second inlet pipe 1200*a* may deliver the second fluid to the plate part 100, a channel connected to the first outlet pipe 1100*b* may deliver the first fluid from the plate part 100 to the outside, and finally, a channel connected to the second outlet pipe 1200*b* may deliver the second fluid from the plate part 100 to the outside.

Therefore, the plate-type heat exchanger 1000 according to the present invention may exchange heat by using various arrangements of the first plate part 100-1 through which the first fluid flows and the second plate part 100-2 through which the second fluid flows.

Figure 12:
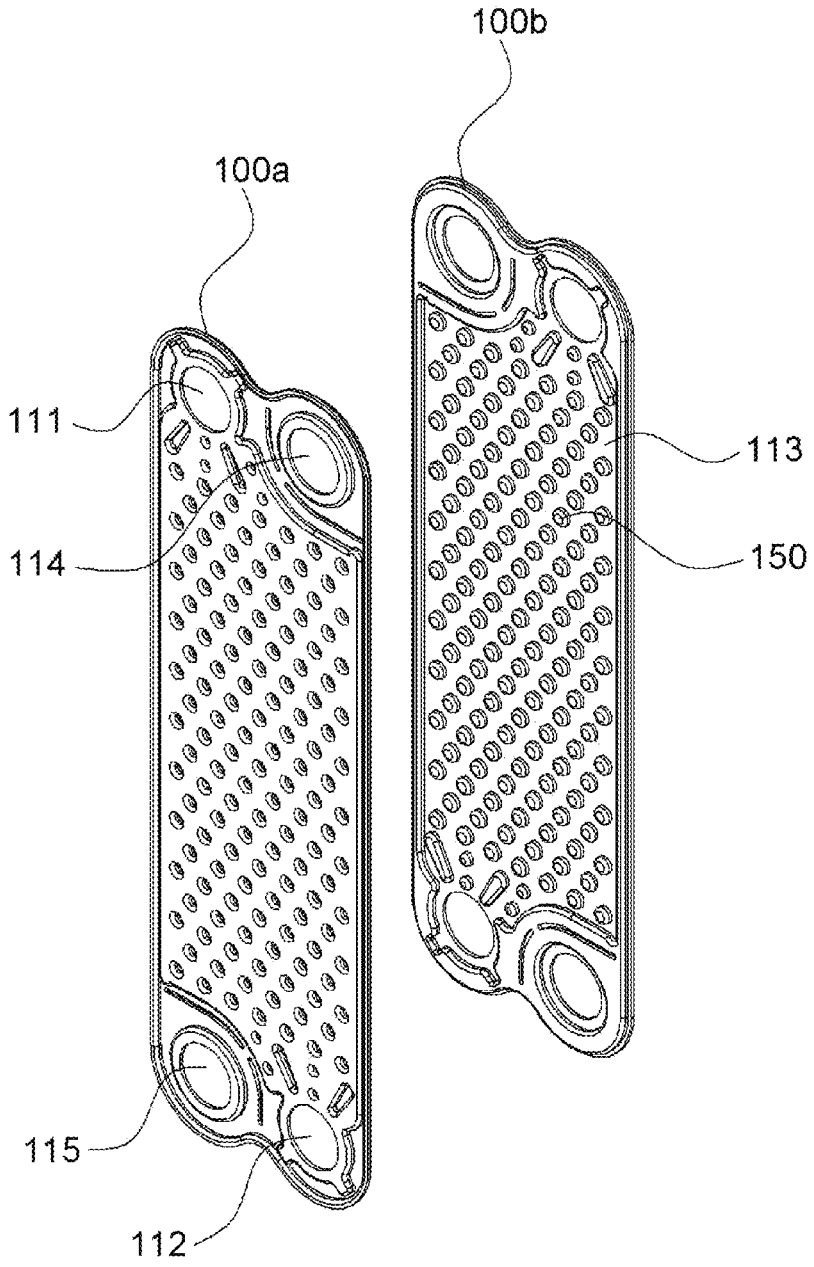
FIG. 12 is an exploded perspective view showing another example of the pair of plates according to the present invention.

Referring to FIG. 12, the flow space part 103 may include a vortex generation part 150 including a plurality of protrusions protruding inward in a state where the plate parts 100 are coupled to each other.

The first fluid or the second fluid passing through the flow space part 103 may be spread and flow widely along an inner area of the flow space part 103 through the vortex generation part 150 to increase heat exchange efficiency between the first fluid and the second fluid, and heat of the first or second fluid may be delivered to the heat dissipation fin to cause additional heat exchange. The heat dissipation fin may be positioned between the pair of vortex generation parts 150, and pressed by the vortex generation parts 150.

Here, the vortex generation part 150 may be an embossing means. In addition, the vortex generation part 150 may absorb the external pressure and impact when the plurality of the plate parts 100 are overlapped with each other by the vortex generation part 150 to prevent the shape deformation or damage of one plate part 100.

The present invention is not limited to the above-mentioned embodiments, and may be variously applied. In addition, the present invention may be variously modified without departing from the gist of the present invention claimed in the claims.

[Description of Reference Numerals]

| | | | |
|---|---|---|---|
| 1000: | plate-type heat exchanger | 1100a: | first inlet pipe |
| 1100b: | first outlet pipe | 1200a: | second inlet pipe |
| 1200b: | second outlet pipe | | |
| 100: | plate part | | |
| 100-1: | first plate part | 100-2: | second plate part |
| 100a, 100b: | plate, first plate, second plate | | |
| 101: | inlet part | 111: | inlet |
| 102: | outlet part | 112: | outlet |
| 103: | flow space part | 113: | flow surface |
| 104: | first movement part | 114: | first movement unit |
| 105: | second movement part | 115: | second movement unit |
| 110: | step part | 120: | round |
| 130: | stopper | 131: | protrusion |
| 131a: | first protrusion | 131b: | second protrusion |
| 131c: | third protrusion | 131d: | fourth protrusion |
| 140: | through outlet part | 150: | vortex generation part |
| 160: | ring part | 170: | groove part |
| 200: | fin part | 210: | first fin |
| 220: | second fin | 230: | through gap |
| a: | fin peak | b: | fin valley |

The invention claimed is:

1. A plate-type heat exchanger comprising:

plates each including an inlet positioned in one side thereof in a longitudinal direction, an outlet positioned in the other side thereof in the longitudinal direction, and a flow surface positioned between the inlet and the outlet; and a fin part inserted into a plate part formed by coupling a pair of plates to each other, and rested on the flow surface, wherein the plate includes a fin part movement-preventing means for the fin part to be rested only on the flow surface by allowing one end of the fin part in the longitudinal direction to be spaced apart from the inlet, and the other end of the fin part in the longitudinal direction to be spaced apart from the outlet, wherein the fin part movement-preventing means includes a step part positioned around the flow surface, the inlet or the outlet, and defining a position on which the fin part is rested, and wherein the step part surrounds a corner of the fin part that is positioned close to the inlet, any one or more corners of one or the other side of the fin part in the longitudinal direction, and does not surround a corner of the fin part that is closest to the inlet or a corner of the fin part that is closest to the outlet and surround a corner of the fin part that is not closest to the inlet or a corner of the fin part that is not closest to the outlet.

2. The plate-type heat exchanger of claim 1, wherein the step part further includes a round positioned to correspond to a corner edge of the fin part.

3. The plate-type heat exchanger of claim 1, wherein the fin part movement-preventing means includes a stopper protruding toward a surface where the fluid flows from a portion of the flow surface, positioned at a point between the inlet and the flow surface or between the flow surface and the outlet.

4. The plate-type heat exchanger of claim 3, wherein the stoppers are respectively positioned on the pair of plates, and in contact with each other inside the plate part.

5. The plate-type heat exchanger of claim 3, wherein the stoppers are a plurality of pillars, and the plurality of pillars are radially arranged with respect to the inlet and the outlet, respectively.

6. The plate-type heat exchanger of claim 3, further comprising a protrusion protruding toward the surface where the fluid flows from a certain region of the flow surface, positioned at a point between the plurality of stoppers when the plurality of the stopper are provided.

7. The plate-type heat exchanger of claim 1, wherein the fin part does not include an opening corresponding to that of the inlet or outlet.

8. The plate-type heat exchanger of claim 7, wherein the fin part includes a through gap positioned between the fins forming wave waveforms different from each other.

9. The plate-type heat exchanger of claim 1, wherein the fin part includes a plate fin in an offset-strip shape.

10. The plate-type heat exchanger of claim 1, wherein the plate part includes first and second plates, at least one ring part is positioned on a circumference of the first plate, and at least one groove part is positioned in a circumference of the second plate and to which the ring part is coupled.

11. The plate-type heat exchanger of claim 2, further comprising:

a first manifold which is positioned at the plate part and through which any one of a first fluid and a second fluid is introduced and discharged, and a second manifold which is positioned at the plate part and through which a fluid not flowing through the first manifold among the first fluid or the second fluid is introduced and discharged, wherein the first manifold and the second manifold are physically separated from each other by the step part.

12. The plate-type heat exchanger of claim 11, wherein the first manifold includes an inlet part including the pair of inlets and through which any one of the first fluid or the second fluid is introduced, a flow space part including the pair of flow surfaces and through which the fluid introduced through the inlet part flows, and an outlet part including the pair of outlets and through which the fluid passing through the flow space part is discharged.

13. The plate-type heat exchanger of claim 12, wherein the second manifold includes a first movement part in which the fluid not flowing through the first manifold flows and a second movement part in which the fluid passing through the first movement part flows.

14. The plate-type heat exchanger of claim 13, wherein the first manifold and the second manifold are positioned in such a manner that a straight line connecting the inlet part and the outlet part to each other and a straight line connecting the first movement part and the second movement part to each other intersect each other in an "X" shape.

15. The plate-type heat exchanger of claim 11, wherein the step part is formed by the first manifold having a certain depth and protruding outward from the plate part.

16. The plate-type heat exchanger of claim 11, wherein the plate part further includes a through outlet part passing through a certain area between the step part and the second manifold.

17. The plate-type heat exchanger of claim 11, wherein the first manifold and the second manifold respectively positioned at different plate parts are cross-stacked on each other when the plurality of plate parts are stacked on each other.

18. The plate-type heat exchanger of claim 12, wherein the flow space part further includes a vortex generation part including a plurality of protrusions protruding inward in a state where the plate parts are coupled to each other.

* * * * *